US007986908B2

(12) United States Patent
Takada

(10) Patent No.: US 7,986,908 B2
(45) Date of Patent: Jul. 26, 2011

(54) FIXING DEVICE AND IMAGE FORMING APPARATUS

(75) Inventor: Mikihiko Takada, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 662 days.

(21) Appl. No.: 12/127,483

(22) Filed: May 27, 2008

(65) Prior Publication Data

US 2009/0074486 A1 Mar. 19, 2009

(30) Foreign Application Priority Data

Sep. 18, 2007 (JP) ..... 2007-240675

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS

2011/0008083 A1* 1/2011 Okamoto ..... 399/329

FOREIGN PATENT DOCUMENTS

| | | | |
|---|---|---|---|
| JP | 2002-148970 | | 5/2002 |
| JP | 2005331576 A | * | 12/2005 |
| JP | 2007-79183 | | 3/2007 |

* cited by examiner

*Primary Examiner* — David M Gray
*Assistant Examiner* — Laura K Roth
(74) *Attorney, Agent, or Firm* — Cantor Colburn LLP

(57) ABSTRACT

A fixing device including an endless fixing belt; a pressure member that presses the fixing belt toward the fixing nip portion from the inner circumferential surface side of the fixing belt; and a sliding sheet that covers the pressure member and extends outside the pressure member in the longitudinal direction thereof wherein a surface other than an opposed surface opposed to the inner circumferential surface of the fixing belt is cut out.

9 Claims, 11 Drawing Sheets

A-A SECTION

B-B SECTION

FIXING DEVICE AND IMAGE FORMING APPARATUS

This application is based on Japanese Patent Application No. 2007-240675 filed on Sep. 18, 2007 in Japanese Patent Office, the entire content of which is hereby incorporated by reference.

BACKGROUND OF THE INVENTION

The present invention relates to a fixing device for heating and pressing a sheet with a toner image, and fixing the toner image onto the sheet, especially to a fixing device using a fixing belt and an image forming apparatus provided with the aforementioned fixing device.

In the conventional art, as the fixing device used in the image forming apparatus using electrophotographic process in a photocopier, printer, fax machine, and multifunction machine provided with the functions thereof, the fixing device of heating roller system (also referred to as a heat-fixing roller system) has been employed over an extensive range from low-speed to high-speed machines as well as from monochromatic to color machines. In the fixing device of heating roller system, heat and pressure are applied to the transfer material with an unfixed toner image formed thereon, by a fixing nip portion made up of a heating roller kept at a predetermined temperature, and a pressure roller having an elastic layer and being pressed against the heating roller, while the transfer material is sandwiched and conveyed thereby.

Widening the fixing nip portion is required to heat toner efficiently on the sheet surface by the demand for colorization and speedup in late years. In this case, viewing the constitution of the aforementioned fixing device of a heat roller system, a means for enlarging the diameters of the two rollers or increasing the pressurizing force between the rollers, thereby increasing the crush (distortion) amount of the rollers would be considered to widen the nip portion. However, when such a method is employed, there may arise a problem with respect to the enlargement of the size of the fixing device and the reduction in durability of the fixing device and the degree of freedom of design conditions is low.

As a method for solving this problem, a fixing device of a belt nip system having an rotating endless fixing belt driven by a roller and a pressing pad fixed on the inner circumferential surface side of the fixing belt and pressing the fixing belt toward the heating roller by the pressing pad has been adopted in recent years. In the fixing device of a belt nip system, from the viewpoint of its constitution, the width of fixing nip portion can be set to be wider than in the heating roller system without growing in size.

The fixing device of nip belt system is designed in such a way that the fixing belt is pressed against the heating roller by means of a pressing member. Accordingly, if there is a great friction between the inner surface of the fixing belt and the pressure member, traveling of the fixing belt is blocked, and this will cause image misregistration or sheet wrinkles.

In an attempt to solve such problems, Unexamined Japanese Patent Application Publication No. 2002-148970 discloses a fixing device to prevent image misregistration from occurring, wherein the aforementioned fixing device is provided with a sheet-shaped member to cover the pressure member for the purpose of reducing the drag of friction with the inner circumferential surface of the fixing belt, and large irregularities are formed on the surface of the sheet-shaped member.

In the fixing device disclosed in the Unexamined Japanese Patent Application Publication No. 2002-148970, however, as a result of repeated use thereof, a lubricant coated on the inner circumferential surface of the fixing belt or a releasing agent coated on the surface of the heating roller spreads inside the sliding sheet from the end part thereof, and sticks to the pressure pad covered by the sliding sheet. If the oil of the releasing agent or others sticks to the pressure pad, the pressure pad is subjected to swelling deformation, and the anticipated functions cannot be performed. This problem has been left unsolved in the conventional art.

To solve the aforementioned problem, the fixing device disclosed in the Unexamined Japanese Patent Application Publication No. 2007-79183 provides an outer extension of the sliding sheet. The end parts thereof are located outside the end parts of the fixing roller and fixing belt to ensure that the releasing agent does not easily spread inside the sliding sheet.

However, the addition of the aforementioned extension causes the sliding sheet to be longer than the fixing belt. Friction between the sliding sheet and the end part of the fixing belt accelerates the abrasion of the sliding sheet, with the result that the sheet tends to break more easily.

An object of the present invention is to solve the aforementioned problems and to provide a fixing device using a fixing belt that ensures that the sliding sheet covering the pressure member which presses the inner circumferential surface of the fixing belt is not broken by friction with the end parts of the fixing belt.

SUMMARY

The object of the present invention can be achieved by the following embodiments of the invention.

(1) A fixing device including a heating section and a pressure section that press the heating section to form a fixing nip portion comprising:

an endless fixing belt;

a pressure member that presses the fixing belt against the fixing nip portion from the inner circumferential surface side of the fixing belt; and a sliding sheet that covers the pressure member and extends outside the pressure member in the longitudinal direction thereof, wherein a surface except for the opposed surface opposed to the fixing belt is formed to be cut out.

(2) A fixing device including a heating section and a pressure section that press the heating section to form a fixing nip portion comprising:

an endless fixing belt;

a pressure member that presses the fixing belt against the fixing nip portion from the inner circumferential surface side of the fixing belt; and a sliding sheet that covers the pressure member and has an extension on a surface including an opposed surface opposed to the fixing belt, wherein an end part of the sliding sheet other than the extension is located inside the end part of the fixing belt; the extension is provided outside the pressure member in a longitudinal direction thereof; and the end part of the extension is located outside the end part of the sliding sheet other than the extension in the longitudinal direction of the pressure member.

(3) An image forming apparatus including:

an image forming section for forming a toner image on a sheet; and the fixing device described in the Item (1) or (2) wherein the toner image formed by the aforementioned image forming section is heated, pressed and fixed onto the sheet in the fixing nip portion.

BRIEF DESCRIPTION OF THE DRAWINGS

FIG. 7(*b*) is a cross section taken along arrow line B-B.

DETAILED DESCRIPTION OF THE PREFERRED EMBODIMENT

The present invention will be described on the basis of embodiments, however the present invention is not limited to the concerned embodiments.

Figure 1:
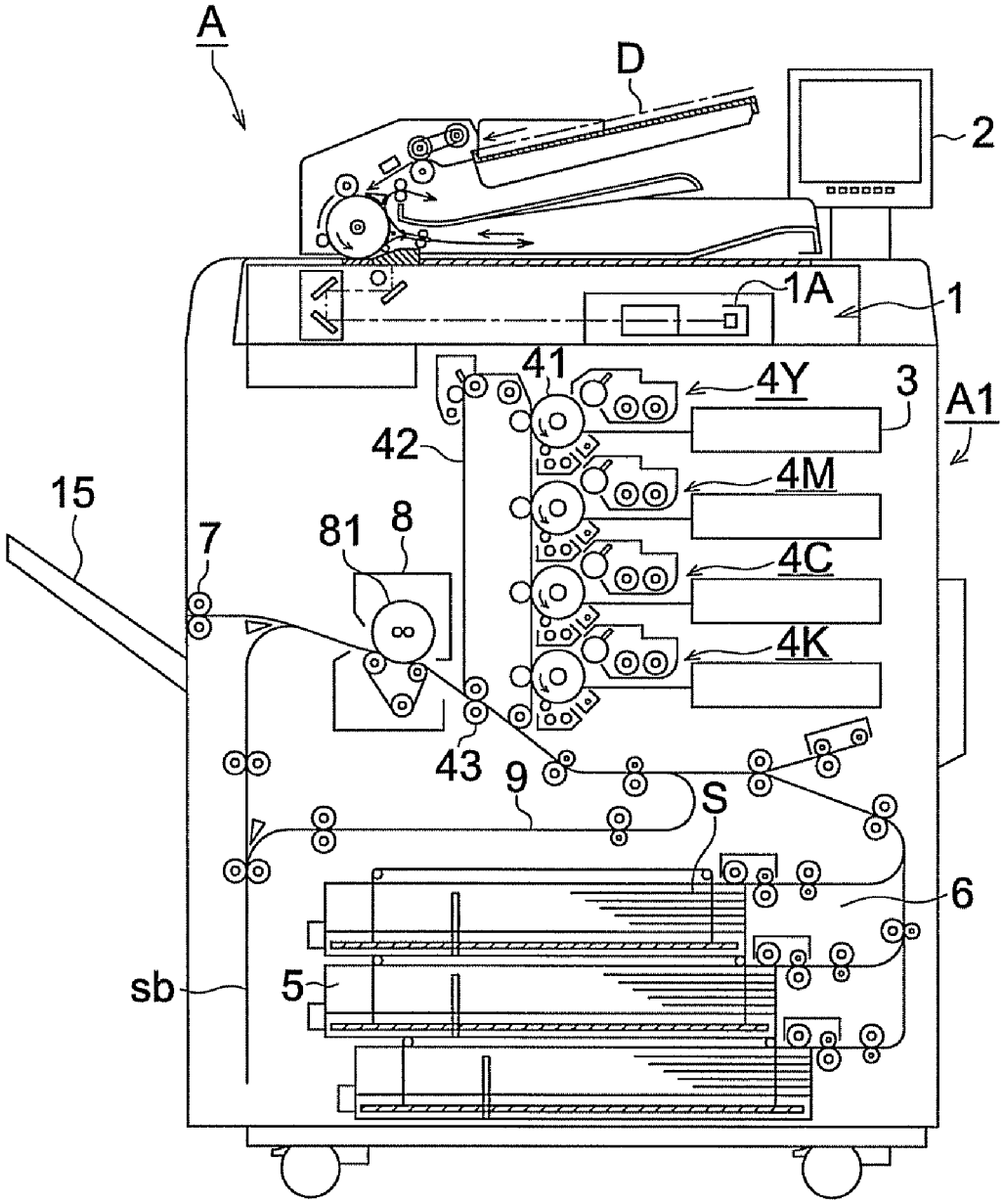
FIG. 1 is a cross sectional view at the central portion of an image forming apparatus of the present invention.

FIG. 1 is a cross sectional view at the center of the image forming apparatus relating to this embodiment. The image forming apparatus A is referred to as a tandem type color image forming apparatus including an image forming section A1, a scanner section 1, an operation display section 2, and an automatic document feeder D.

The image forming section A1 includes a plurality of sets of image generation sections 4Y (yellow), 4M (magenta), 4C (cyan), and 4K (black), an image writing section 3 (reference symbols for M, C, K are omitted), a intermediate transfer belt 42, a sheet feed cassette 5, a sheet feeding section 6, a sheet ejection section 7, a fixing device 8, a duplex copy feed section 9. With respect to the detail of the fixing device 8 will be described later.

The image generation sections 4 (4Y, 4M, 4C, 4K) have a developing device and contain respectively a 2-component developer composed of toner of small-diameter particles of each color of yellow (Y), magenta (M), cyan (C), and black (K) and a carrier.

On the upper part of the image forming apparatus A, the automatic document feeder D is loaded. A document loaded on the document table of the automatic document feeder D is conveyed in the direction of the arrow, and an image on one side or images on both sides of the document are read by the optical system of the scanner section 1 and read into a CCD image sensor 1A.

For an analog signal converted photoelectrically by the CCD image sensor 1A, the memory controller performs the analog process, A-D conversion, shading correction, and image compression and then sends a signal to the image writing section 3.

In the image writing section 3, output light from the semiconductor laser is emitted to photosensitive drums 41 (for M, C, and K, the reference numerals are omitted) of the image generation section 4 and a latent image is formed. In the image generation section 4, the processes of charging, exposure, development, transfer, and cleaning are performed. Toner images of the respective colors formed by the image generation section 4 are sequentially transferred onto the rotating intermediate transfer belt 42 by the primary transfer device and a composite color image is formed.

The toner images on the intermediate transfer belt 42, by the secondary transferring roller 43, are transferred to a sheet S conveyed by the sheet feeding conveyance section 6 from the sheet feed cassette 5. The sheet S carrying the toner images is subjected to heat pressure fixing by the fixing device 8, is ejected outside from the sheet ejection section 7, and is loaded on a sheet ejection tray 15.

The numeral 9 denotes a double side conveying path. When forming images on both sides of the sheet, the sheet S after image formation on its first surface (front surface) and fixing by the fixing device 8 is conveyed to the double side conveying path 9, inverted front to back by the switch back path and is again conveyed to the image generation section 4. After image formation on the second surface (back surface), it is discharged to outside the apparatus by the sheet discharging section 7 and placed on the sheet discharge tray 15.

[Fixing Device]

Figure 2:
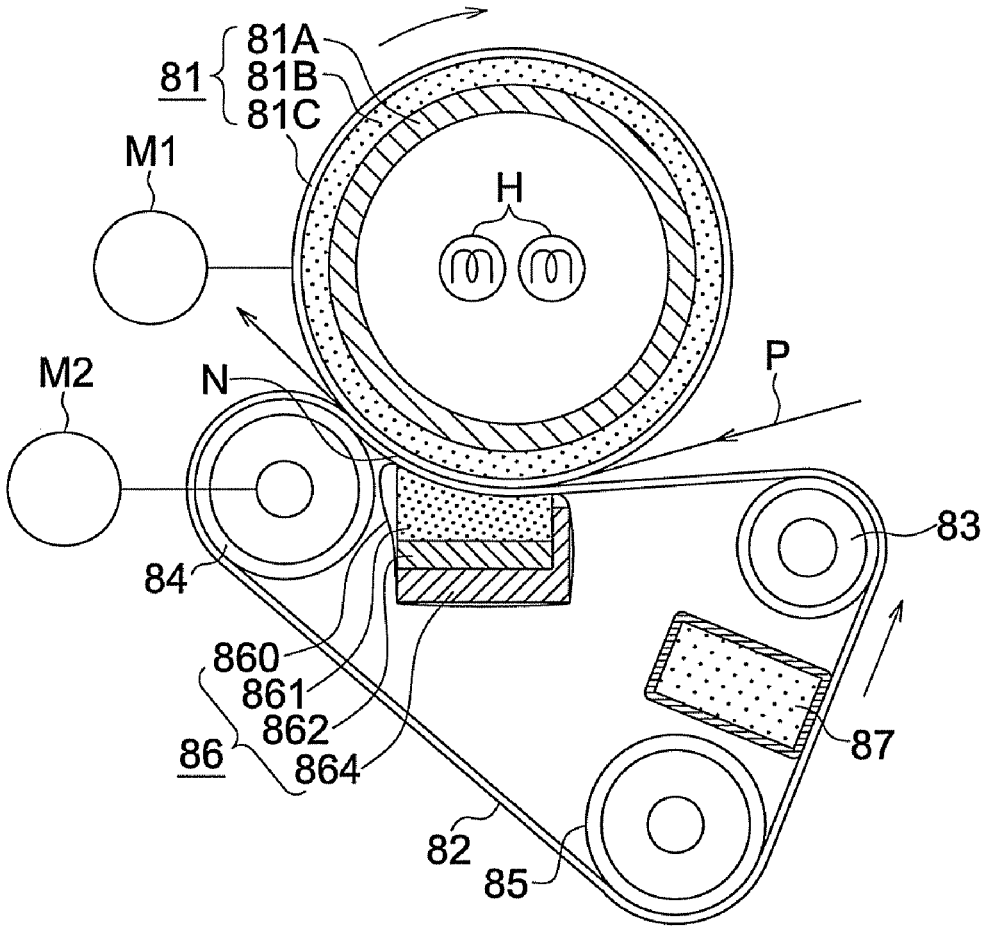
FIG. 2 is a cross sectional view at the central portion of an image forming apparatus 8 of belt nip system.

The following describes the major components' of the fixing device 8 of belt nip system of the present embodiment. FIG. 2 is a cross sectional view at the central portion of the fixing device 8 of belt nip system.

In the fixing device 8 of the present invention, heat and pressure are applied to the toner image on sheet S by the fixing nip portion N formed between the heating roller 81 (also called the fixing roller) heated by a halogen heater H, and the fixing belt 82, and the toner image is fixed onto the sheet. In this case, the heating roller 81 and halogen heater H are used as a heating section, and fixing belt 82 and a plurality of rollers for supporting the fixing belt serve as a pressure section. Further, the fixing nip portion is formed by the heating section and pressure section which are pressed against each other.

The heating roller 81 incorporates the halogen heater H serving as a heat source, and is composed of a cylindrical mandrel 81A made of aluminum, iron or the like; an elastic layer 81B made of an heat-resistant HTV silicone rubber to cover the cylindrical mandrel 81A; and a releasing layer 81C made of a fluorine resin such as PFA (perfluoro alkyl vinyl ether) or PTFE (polytetrafluoro-ethylene) to cover the elastic layer 81B.

The fixing belt 82 includes a substrate formed of a heat resistant elastic resin such as polyimide having a thickness of 70 μm; an elastic layer such as a silicone rubber layer having a thickness of 200 μm to cover the outer surface of the substrate; and a releasing layer made of PFA or PTFE having a thickness of 30 μm to cover the elastic layer. The fixing belt 82 is designed to have an endless configuration.

The fixing belt 82 is applied to the outer peripheries of the roller 83 located close to the introductory part of sheet S, the pressure roller 84 on the outlet side of the sheet S and the supporting roller 85, and is brought in contact with the outer peripheral surface of the heating roller 81.

The roller 85 is also called the steering roller. The axis of the roller 85 is tilted by rocking one end of the axis, whereby the roller 85 serves as a skew regulating member to correct the skew of the fixing belt.

[Pressure Section]

The pressure section 86 pressing the fixing belt 82 from inside presses the fixing belt 82 from its inner circumferential surface side to the fixing nip portion side in the vicinity of the upstream side of the pressure roller 84 arranged on the downstream side of the fixing nip portion N out of the rollers 83, 84 and 85 to which the fixing belt 82 is applied. The pressure section 86 includes the pressure pad 861 serving as a pressure member, the holding member 862 for holding a pressure pad 861, compression spring 863 (not illustrated) urging the holding member 862, the holder 864 for storing these, and the sliding sheet 860 which covers the pressure pad 861 and slides on the inner circumferential surface of the fixing belt 82.

The pressure section 86 that presses the fixing belt 82 from inside is arranged in the vicinity of the upstream side of the pressure roller 84, out of the rollers 83, 84 and 85 to which the fixing belt 82 is applied. The pressure section 86 together with the pressure roller 84 presses the fixing belt 82 against the heating roller 81, and thereby forming a fixing nip portion N. The pressure section 86 includes a pressure pad 861 as a pressure member; a holding member 862 for holding the pressure pad 861; a holder 864 for securing the holding member 862 wherein both end parts of the holder 864 are supported by a supporting member (not illustrated); and a sliding sheet 860 that covers the pressure pad 861, and slides along the inner circumferential surface of the fixing belt 82.

The pressure pad 861 is made of heat resistant rubber as exemplified by a silicone rubber having a hardness of JISA 10° through 30°. It is in a shape conforming to the curved surface of the heating roller 81 and formed on the holding member 862. The holding member 862 is made of stainless steel, for example. The sliding sheet is made of a heat resistant resin such as polyimide having a thickness of 70 μm, for example, and is formed by emboss molding so that 0.2 mm-high protrusions are arranged at an interval of 0.5 through 1 mm to form irregularities. Formation of irregularities reduces the area in contact with the fixing belt 82 so that friction is reduced. Use of the polyimide increases the strength and enhances resistance to breakage. The holder 864 is made of stainless steel. The sliding sheet 860 covers the pressure pad 861 and is secured onto the holder 864. It can be formed in a tube-shaped form and can be secured on the upstream side alone. Alternatively, it can be formed in a non-tube-shaped form and can be secured on the upstream and downstream sides. The holder 864 is pressed by a compression spring through a supporting member.

[Lubricant Supply Member]

The lubricant supply member 87 is arranged on the upstream side of the pressure section 86 in the direction of conveying the fixing belt 82, and on the side of the inner circumferential surface of the fixing belt 82.

The lubricant supply member 87 is formed of a felt such as an aramid fiber. A lubricant reservoir is formed by filling the felt into the bag-shaped PTFE porous film. The lubricant supply member 87 is impregnated with lubricant in advance. The lubricant reservoir stores the lubricant and supplies it through the PTFE porous film on the outer peripheral surface. Silicone oil such as dimethyl silicone oil with a viscosity of 100 through 1000 cs or methylphenyl silicone oil with a viscosity of 100 through 1000 cs is used as the lubricant.

In the fixing device 8 constructed in the aforementioned manners the heating roller 81 heated by the halogen heater H and driven by the motor M1 rotates in the clockwise direction as illustrated. The pressure roller 84 at the outlet is driven by the motor M2, and rotates the fixing belt 82. The rollers 83 and 85 are driven by rotation of the fixing belt 82. The pressure pad 861 is pressed by the compression spring through the holder 864 and holding member 862. The pressure pad 861 presses the fixing belt 82 against the heating roller 81. The pressure roller 84 presses the fixing belt 82 against the heating roller 81 by the compression spring through the supporting member that support the end part of the pressure roller 84.

Thus, a wide fixing nip portion N is formed between the pressure section 80 (fixing belt unit) and heating roller 81. The fixing belt 82 rotates in the counterclockwise direction as illustrated, by the drive and rotation of the heating roller 81 and pressure roller 84. The unfixed toner on the sheet S having been conveyed is heated and pressed by the fixing nip portion N and is fixed on the sheet S.

Further another structure will be described as follows.

On the upstream side in the direction of conveying the fixing belt 82 of the pressure section 86, a lubricant supply member 87 is arranged on the side of the inner circumferential surface of the fixing belt 82.

The lubricant supply member 87 is made of a non-woven fabric such as aramid fiber. A bag-shaped non-woven fabric is filled with a foam material such as a felt or others to form a lubricant reservoir. The lubricant supply member 87 is impregnated with lubricant in advance. The lubricant reservoir stores the lubricant and supplies it to the non-woven fabric of the outer peripheral surface. Silicone oil such as dimethyl silicone oil with a viscosity of 1000 cs or methyl phenyl silicone oil with a viscosity of 400 cs can be used as the lubricant.

In the fixing device 8 having the aforementioned structure, the heating roller 81 heated by a halogen heater H and driven by a motor M1 rotates in the clockwise direction as illustrated. Further, the pressure pad 861 is pressed by the compression spring 863 through the holding member 862, and the pressure pad 861 presses the fixing belt 82 against the heating roller 81.

Thus, the fixing belt 82 is rotated in the counterclockwise direction as illustrated, by the heating roller 81 which is driven in the clockwise direction by the motor M1. The fixing belt 82 is pressed against heating roller 81 by the pressure pad 861, and is subjected to elastic transformation, whereby a wide fixing nip portion N is formed between the pressure section 80 (fixing belt unit) and heating roller 81. The unfixed toner on the sheet S having been conveyed is heated and pressed by the fixing nip portion N, and is fixed on the sheet S.

The roller 84 of the outlet side is driven by the motor M2 so that the fixing belt 82 is rotated. The rollers 83 and 85 are driven by the rotation of the fixing belt 82.

Figure 3:
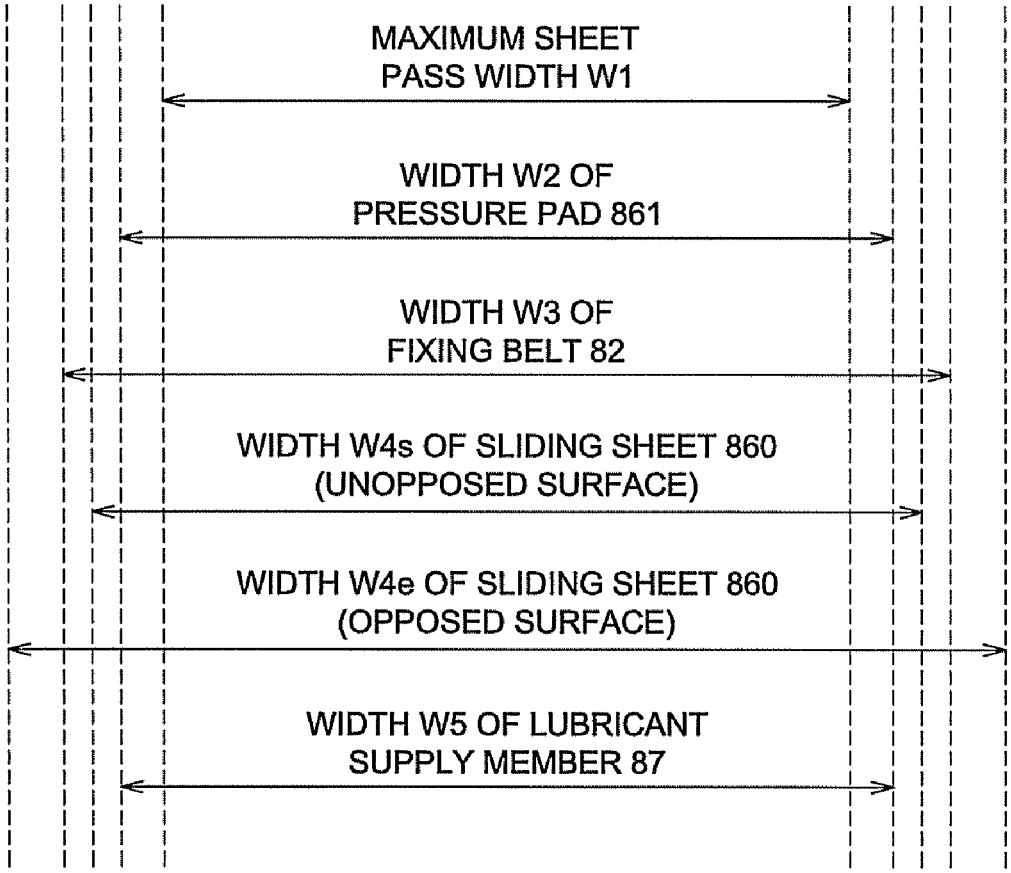
FIG. 3 is a diagram showing the positional relationship of each member of the fixing device 8 in the direction perpendicular to the sheet direction.

Referring to FIG. 3, the following describes the positional relationship of the members of the fixing device 8 in the direction perpendicular to the direction of sheet feed (hereinafter referred to as "axial direction"). In FIG. 3, setting is so made that the following relationship can be expressed, wherein W1 is the maximum sheet pass width of sheet S, W2 is the width of the pressure pad 861, W3 is the width of the fixing belt 82, W4*e* is the total width of the sliding sheet 860 including the extension surface 860*e*, W4*s* is the width of the sliding sheet 860 excluding the extension surface, W5 is the width of the lubricant supply member 87. The extension surface 860*e* of the sliding sheet will be described later.

$$W4e>W3>W4s>W2>W1,$$

$$W5\geqq W2$$

The width W4 of the sliding sheet 860 is set at a value greater than the width W3 of the fixing belt 82. This is intended to ensure that the lubricant coated on the inner circumferential surface of the fixing belt will not enter the sliding sheet 860 from the end part of the sliding sheet 860 to stick to the pressure pad 861. If lubricant sticks to the pressure pad 861, the pressure pad 861 will be deformed by oil swelling, and a predetermined level of pressure will be changed, with the result that wrinkles will occur to the sheet during conveyance, or other problems will occur.

Figure 4:
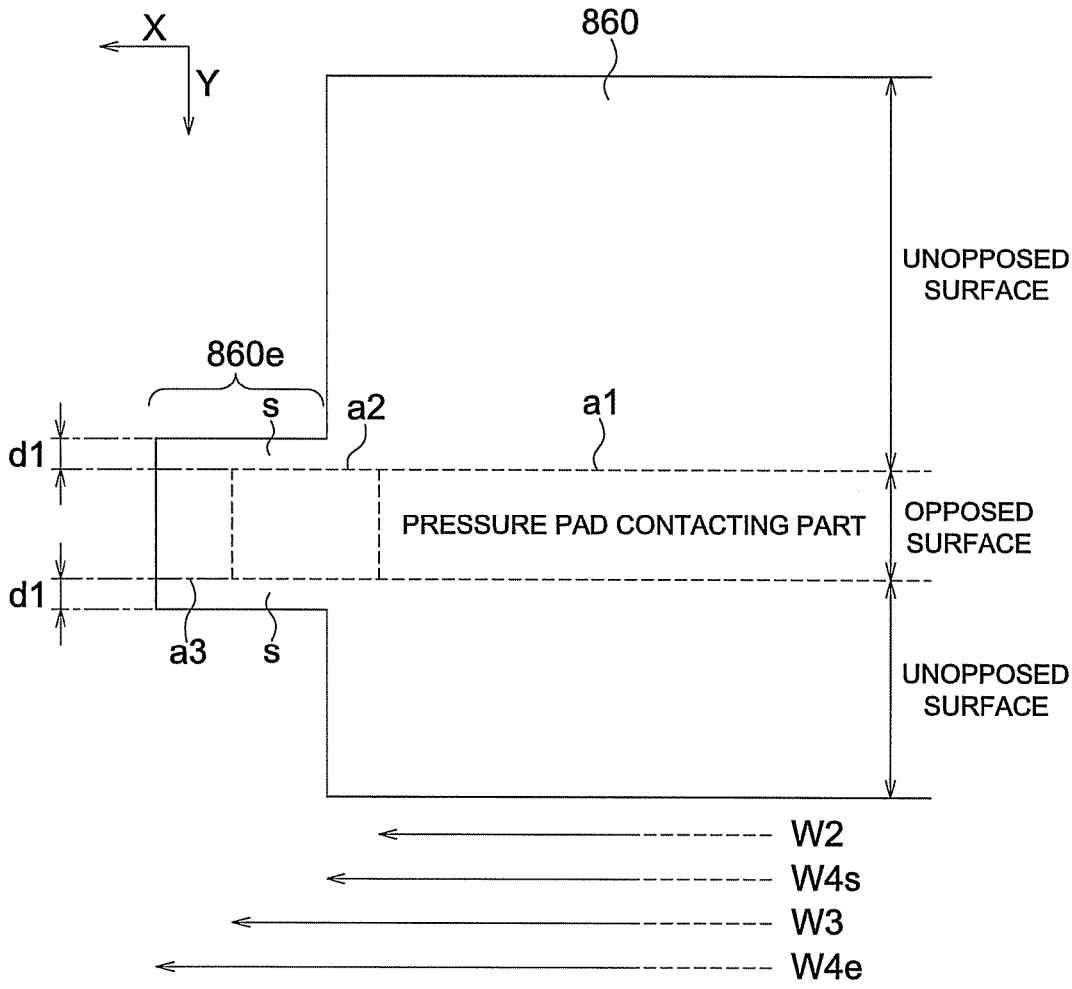
FIG. 4 is an expansion plan of a sliding sheet 860.

Referring to FIGS. 4 through 7, the following describes the sliding sheet of the first embodiment. FIG. 4 is an expansion plan of a sliding sheet 860. In these drawings, only the end part on one side is illustrated. The other end part (not illustrated) also exhibits bilateral symmetry. The areas a1, a2 and a3 are an opposed surfaces opposed to the fixing belt. Of these areas, "a1 " denotes a "sliding surface" sliding on the inner circumferential surface of the fixing belt 82 which is pressed by the pressure pad 861. The area "a2" refers to the surface in contact with the inner circumferential surface of the fixing belt 82 located outside the pressure pad. The area "a3" is the surface located outside the end parts of the fixing belt. To be more specific, the end part of the sliding sheet (including the extension) is located outside the end parts of the fixing belt. The end parts of the sliding sheet other than the extension (excluding the extension) is located inside the end parts of the fixing belt.

The "sliding surface" sliding on the inner circumferential surface of the fixing belt 82 in the sense in which it is used here refers to the opposed surface opposed to the fixing belt 82. It is the portion pressed from the rear surface thereof by the pressure pad 861 against the side of the inner circumferential surface of the fixing belt 82.

In the diaphragm, the sliding sheet 860 is provided with the extension surface 860*e* obtained by extending the surface including the opposed surface opposed to the aforementioned the inner circumferential surface of the fixing belt up to the area a3 in the x-axis direction of the diagram (in the longitudinal direction of the pressure member). The end parts other than the extension are located at the position corresponding to the area a2 inside the end parts of the fixing belt.

Further, the side face portions "s" having a length of d1 are arranged on both sides in the Y-axis direction (perpendicular to the longitudinal direction of the pressure member) from the surfaces a2 and a3 opposed to the inner circumferential surface of the fixing belt. To put it another way, the side face portion "s" is provided on a surface in contact with the opposed surfaces (a2 and a3 of FIG. 4) in the Y-axis direction of the extension surface 860*e*. When the pressure pad 861 is covered with the sliding sheet 860, the extension surface 860*e* as a whole forms a gutter by folding the side face portion "s". The side face portion "s" of the extension surface 860*e* serves as a protective wall that prevents lubricant from entering the pressure pad 861.

Figure 5:
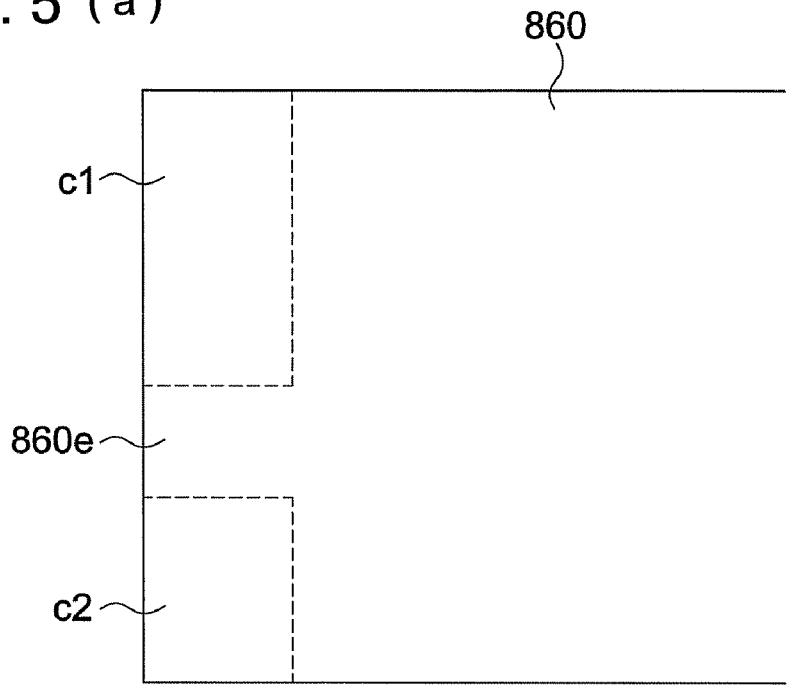
FIG. 5(*a*) shows the method of manufacturing the sliding sheet by cutting and FIG. 5(*b*) represents the method of manufacturing the sliding sheet by pasting.
Figure 5:
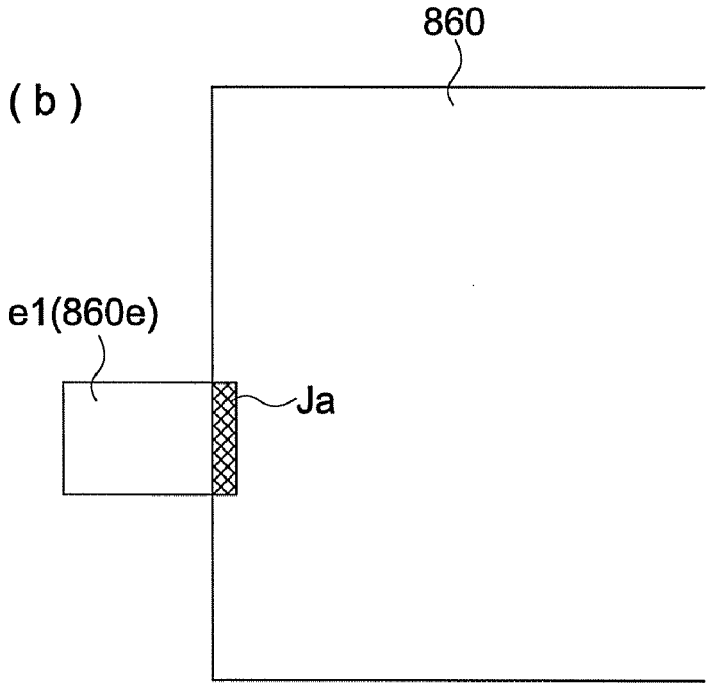

The following describes the method of manufacturing the sliding sheet shown in FIG. 4: FIG. 5(*a*) shows the method of manufacturing the sliding sheet by cutting. FIG. 5(*b*) represents the method of manufacturing the sliding sheet by pasting.

In FIG. 5(*a*), the sliding sheet shaped as shown in FIG. 4 is produced by cutting off the areas C1 and C2 as parts of the rectangular sliding sheet. In FIG. 5(*b*), the sliding sheet shaped as shown in FIG. 4 is produced by pasting the small rectangular sheet e1 to the sliding sheet 860. It should be noted that the area "ja" shown in this diaphragm is the area to be bonded, and is used to bond both sheets by an adhesive.

The sliding sheet 860 shown in FIG. 4 can be defined as "a sliding sheet having a form obtained by cutting out other than the surface opposed to the inner circumferential surface of the fixing belt, outside the pressure member in the longitudinal direction", and as "a sliding sheet equipped with an extension produced by extending the sliding surface sliding on the inner circumferential surface of the fixing belt outward from the pressure member. The term "cutout" in the sense in which it is used here refers to the portion produced by partially cutting out on the end part of the sliding sheet.

Figure 6:
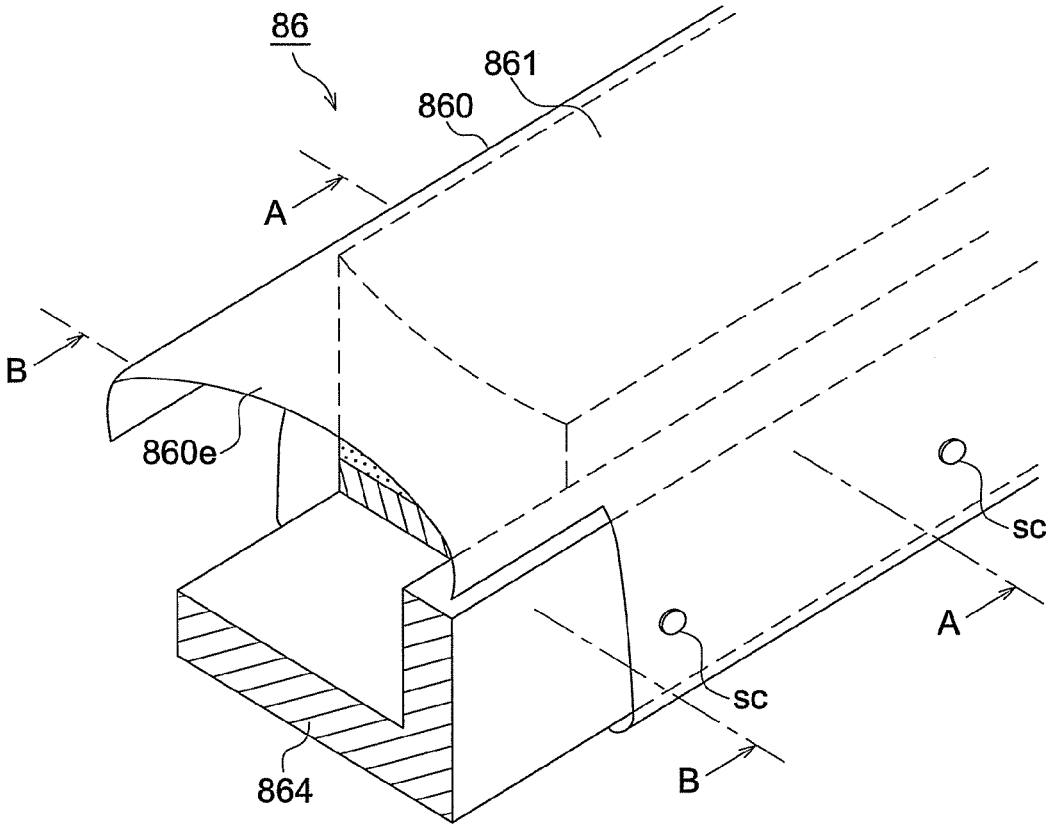
FIG. 6 is a perspective view of the pressure section 6.
Figure 7:
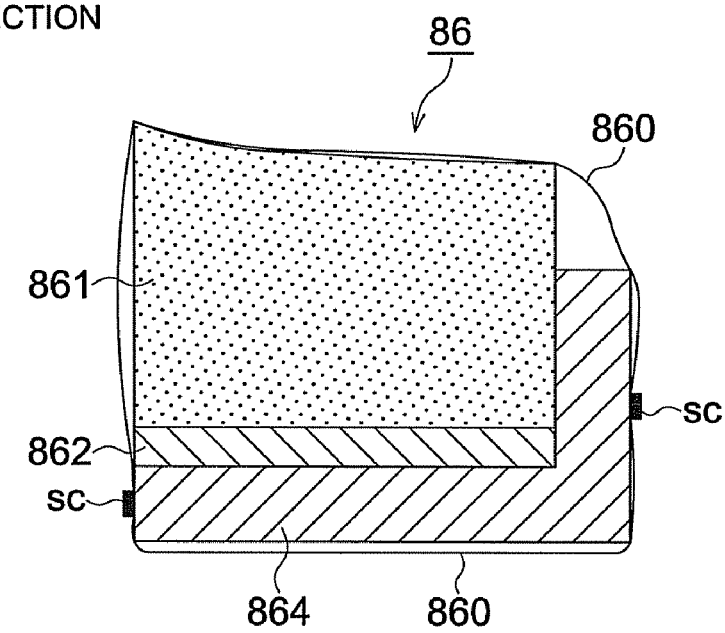
FIG. 7(*a*) is a cross section taken along arrow line A-A of FIG. 6.
Figure 7:
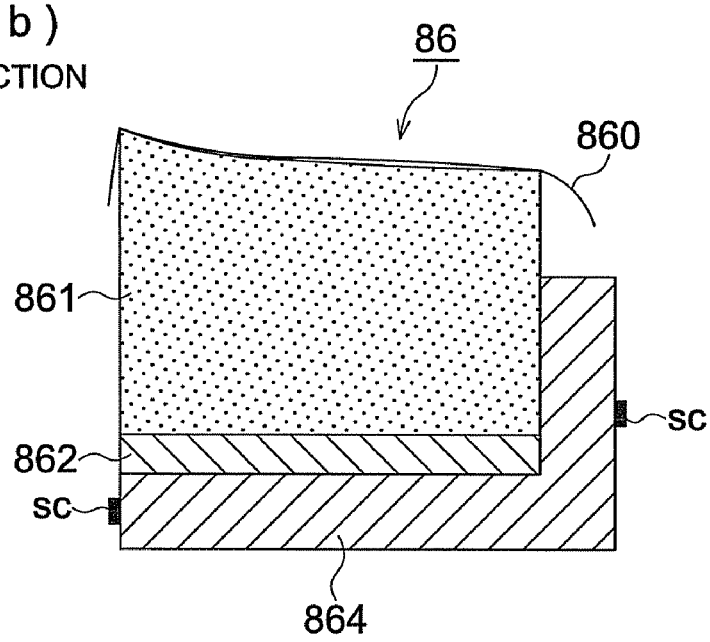

Referring to FIGS. 6, 7(*a*), and 7(*b*), the following describes a situation in which the sliding sheet 860 shown in FIG. 4 is mounted on the pressure section 86. FIG. 6 is a perspective view of the pressure section 6. FIG. 7(*a*) is a cross section taken along arrow line A-A of FIG. 6. FIG. 7(*b*) is a cross section taken along arrow line B-B.

As shown in FIG. 6 and FIG. 7(*a*), on the middle part, the sliding sheet 860 is tube-shaped when the sliding sheet 860 is mounted on the pressure section 86. It should be noted that the sheet is secured on the pressure section 86 by the screw SC of these diaphragms. After it has been bonded in a tube-shaped form, the pressure pad 861 is covered therewith. Then the screw SC can be only one on the upstream side. It is also possible to make such arrangements that the side surface is mostly covered, without being perfectly tube-shaped.

Rigidity is increased when the planar sliding sheet 860 is made into a tube shape. To put it another way, when the side surface supports the opposed surface to the inner circumference of the belt, the pressure applied from above in this diaphragm cannot be easily dissipated. When the sheet is mounted on the fixing device 8, there is a fixing belt 82 above, and the pressure to the fixing belt 82 will be increased more than necessary. Especially on the end parts of the fixing belt 82, the sheet tends to be broken by friction of the fixing belt 82 with the sliding sheet 860.

For the purpose of reducing the pressure onto the fixing belt 82 to solve the aforementioned problem, both end parts of the sliding sheet are shaped as shown in FIG. 6 and FIG. 7(*b*). This arrangement makes it possible to reduce the rigidity of the sliding sheet 860 on the end parts of the sliding sheet, and to decrease the pressure onto the fixing belt 82. Hence, this provides a fixing device which ensures that the sliding sheet covering the pressure member is not broken by friction on the sliding sheet with the end part of the fixing belt.

[Other Embodiments of the Fixing Device]

Figure 8:
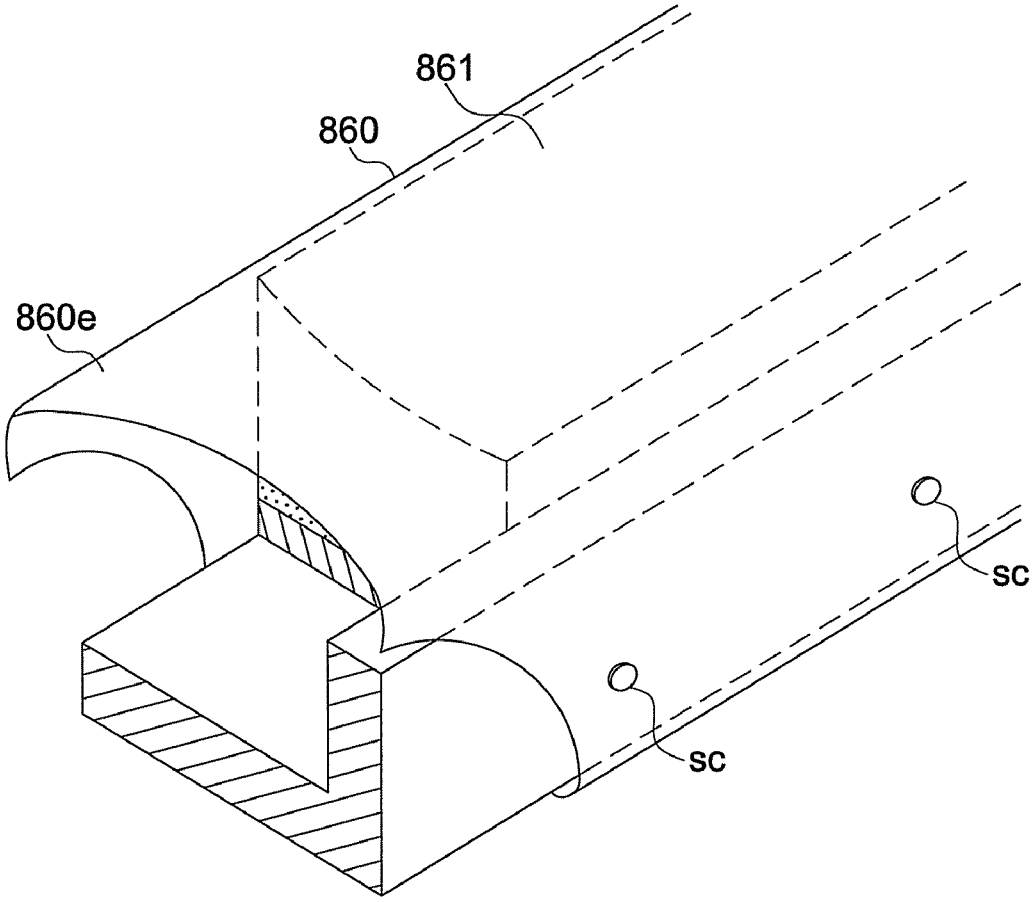
FIG. 8 shows the sliding sheet 860 of the second embodiment.
Figure 9:
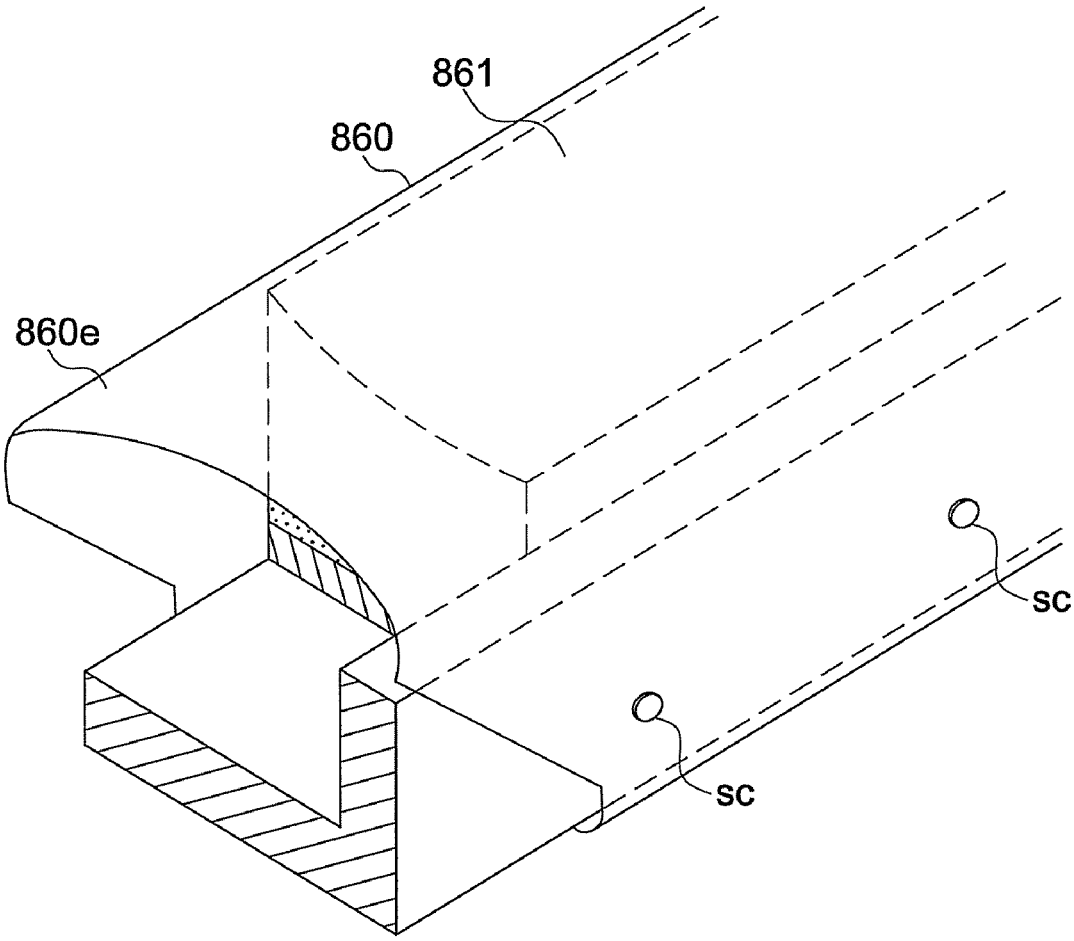
FIG. 9 shows the sliding sheet 860 of the third embodiment.
Figure 10:
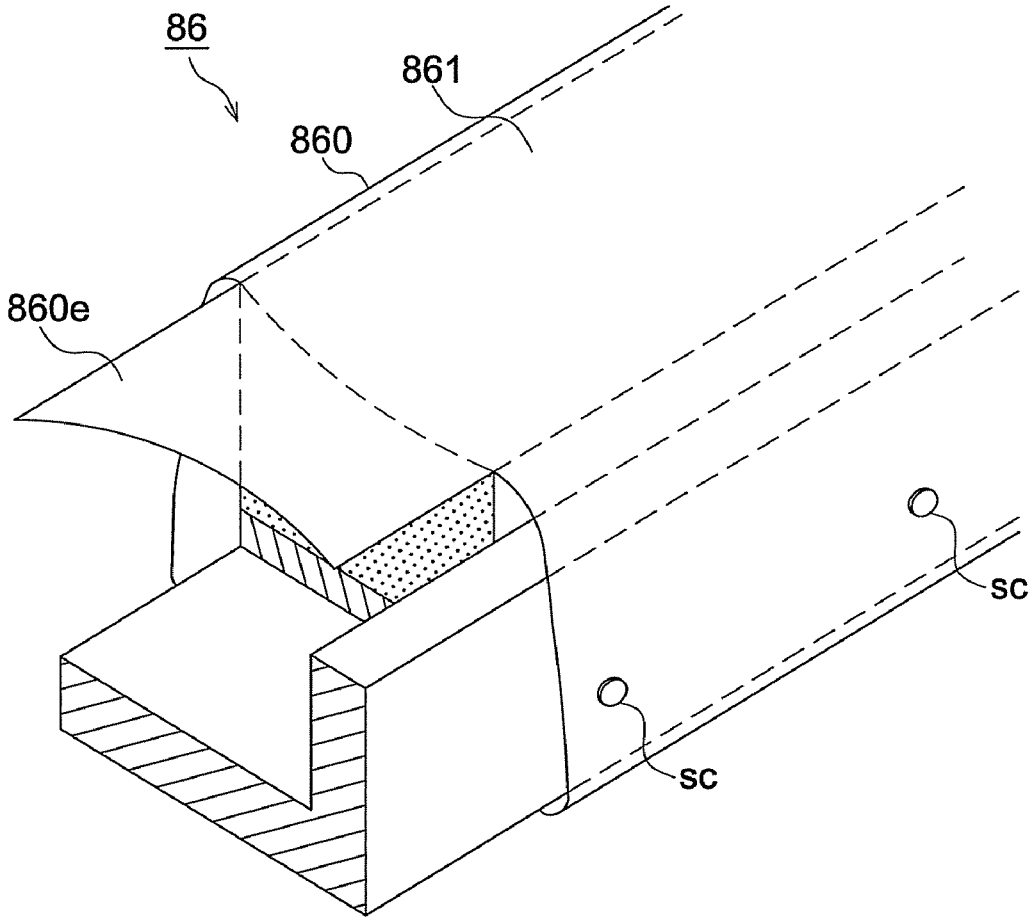
FIG. 10 shows the sliding sheet 860 of the fourth embodiment.

Referring to FIGS. 8 through 10, the following describes the sliding sheet 860 as another embodiment: FIG. 8 shows the sliding sheet 860 of the second embodiment. In this diaphragm, the connection of the side face portion "s" of the extension surface 860*e* is designed in a radius shape.

FIG. 9 shows the sliding sheet 860 of the third embodiment. In this diaphragm, the form of the connection of the side face portion "s" of the extension surface 860*e* is cut away in an oblique direction.

FIG. 10 shows the sliding sheet 860 of the fourth embodiment. The side face portion "s" of FIG. 4 is eliminated in FIG. 10. In the fourth embodiment, the pressure onto the fixing belt 82 due to the rigidity of the sliding sheet 860 is reduced below that of the first through third embodiments.

As shown in FIG. 8 through FIG. 10, when provided with the "a sliding sheet equipped with an extension 860*e* produced by extending the sliding surface sliding on the inner circumferential surface of the fixing belt 82 outward from the pressure member", or "a sliding sheet having a form obtained by cutting out other than the surface opposed to the inner circumferential surface of the fixing belt 82 outside the pressure member in the longitudinal direction", the fixing device can be designed to ensure that the sliding sheet is not broken by friction on the sliding sheet with the end parts of the fixing belt.

[Other Embodiments of Fixing Device]

Figure 11:
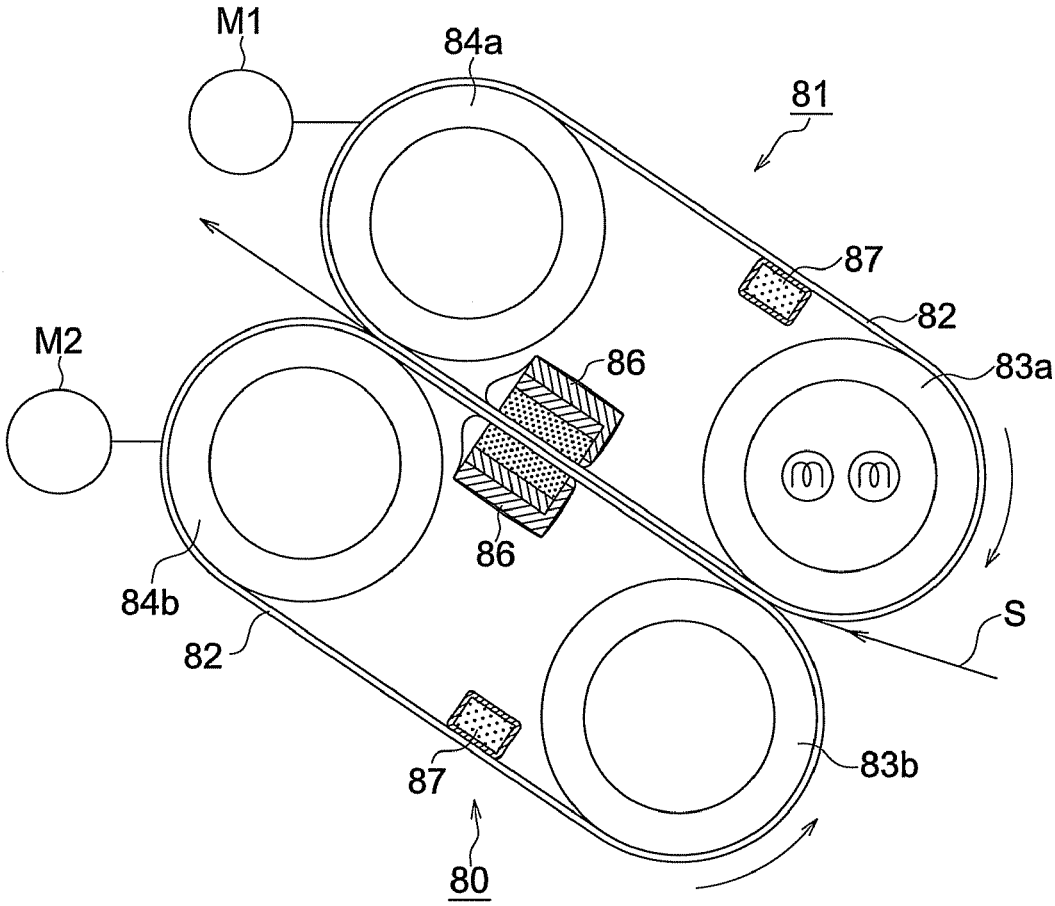
FIG. 11 is a diaphragm showing an example of the fixing device wherein each of the pressure section 80 and the heating section 81 provided with a heat source is equipped with a fixing belt 82.

With reference to FIGS. 1 through 10, description has been made of the fixing device provided with a fixing belt 82 only on the side of the pressure section. Without the present invention being restricted thereto, the fixing device can be equipped with a fixing belt and pressure member on the inner circumferential surface of the fixing belt, on the heating section or on both the heating section and pressure section. FIG. 11 is a diaphragm showing an example of the fixing device wherein each of the pressure section 80 and the heating section 81 provided with a heat source is equipped with a fixing belt 82. In the fixing device shown in this diagram, both the fixing belts are provided with a sliding sheet 860 shown in any one of FIGS. 6, 8 through 10, pressure pad 861, and lubricant supply member 87. In this diagram, the components having the same functions as those of FIGS. 1 through 10 are assigned with the same reference numerals, and will not be described to avoid duplication.

When designed in such a way that two fixing belts illustrated in the diagram are equipped with the sliding sheet 860 shown in FIG. 6 and others, the fixing device ensures that the sliding sheet is not broken by friction on the sliding sheet with the end parts of the fixing belt.

EXAMPLE

The following describes the Examples of the present invention: In Examples, the fixing device and image forming apparatus illustrated in FIGS. 1 through 10 were employed.

[Test Conditions]

The A4-sized sheet was printed on a continual basis at a speed of 80 sheets per minute using the fixing device of Examples 1 through 3 shown below. The number of prints was checked and evaluation was made to see if the end part of the sliding sheet 860 was broken or not.

Example 1

Fixing Device using the Sliding Sheet 860 of FIG. 6 (FIG. 6 and Others)

Example 2

Fixing Device using the Sliding sheet 860 of FIG. 8 (FIG. 8 and Others)

Example 3

Fixing Device using the Sliding Sheet 860 of FIG. 9

Example 4

Fixing Device using the Sliding Sheet 860 of FIG. 10

[Test Result]

TABLE 1

| Number of prints (kp) | Comparative example | Example 1 | Example 2 | Example 3 | Example 4 |
|---|---|---|---|---|---|
| 100 | A | A | A | A | A |
| 150 | A | A | A | A | A |
| 200 | B | A | A | A | A |
| 250 | | A | A | A | A |
| 300 | | A | A | A | A |

TABLE 2

| | Comparative example | Example 1 | Example 2 | Example 3 | Example 4 |
|---|---|---|---|---|---|
| Spread of oil | No | No | No | No | Yes |

As shown in Table 1, breakage occurred at 200 kp in the Comparative Examples. In Examples 1 through 4, breakage of the sliding sheet 860 did not occur within the range of the replacement cycle of the fixing device 8 up to 300 kp. Method and level of evaluation:

Evaluation was made to see if the end part of the sliding sheet 860 was broken or not.

A: Sheet not broken

B: Sheet broken

As shown in Table 2, entry of lubricant was observed in Example 4. This is because, in Example 4, the extension 860*e* is not equipped with side face portion "s", differently from Examples 1 through 3. Thus, there was considered to be entry of lubricant from the end part on the upstream side in the direction of moving the fixing belt 82. The volume of lubricant entry was smaller than that in the absence of an extension.

The present invention provides a fixing device using a fixing belt that ensures that the sliding sheet covering the pressure member for pressing the inner circumferential surface of the fixing belt is not broken by friction on the sliding sheet with the end part of the fixing belt.

What is claimed is:

1. A fixing device including a heating section and a pressure section which presses the heating section to form a fixing nip portion comprising:

an endless fixing belt;

a pressure member which presses the fixing belt toward the fixing nip portion from a side of an inner circumferential surface of the fixing belt; and a sliding sheet which covers the pressure member and extends outside the pressure member in a longitudinal direction thereof, wherein at a longitudinal end of the sliding sheet, cut out portions are cut from the longitudinal end except for a portion that is opposed to the fixing belt.

2. The fixing device of claim 1, wherein a portion covering the pressure member in the sliding sheet is formed tube-shaped.

3. A fixing device including a heating section and a pressure section which presses the heating section to form a fixing nip portion comprising:

an endless fixing belt;

a pressure member which presses the fixing belt toward the fixing nip portion from a side of an inner circumferential surface of the fixing belt; and a sliding sheet which covers the pressure member and has an extension on a surface including an opposed surface opposed to the fixing belt, wherein an end part of the sliding sheet other than the extension is located inside an end part of the fixing belt, the extension is provided outside the pressure member in a longitudinal direction thereof, and an end part of the extension is located outside the end part of the sliding sheet other than the extension in the longitudinal direction of the pressure member.

4. The fixing device of claim 3, further comprising, a lubricant supply member for supplying a lubricant to the inner circumferential surface of the fixing belt, wherein the sliding sheet other than the extension is formed tube-shaped, and wherein the extension has a side face portion extending to the opposed surface in a direction perpendicular to the longitudinal direction.

5. The fixing device of claim 4, wherein, as the side face portion is further away from the opposed surface, a length of the side face portion in the longitudinal direction is shorter.

6. The fixing device of claim 1, wherein an end part of an extension is positioned outside an end part of the fixing belt in the longitudinal direction of the pressure member.

7. The fixing device of claim 3, wherein an end part of an extension is positioned outside an end part of the fixing belt in the longitudinal direction of the pressure member.

8. An image forming apparatus comprising:

an image forming section for forming a toner image on a sheet; and the fixing device of claim 1 which heats, presses and fixes the toner image formed by the image forming section onto the sheet in the fixing nip portion.

9. An image forming apparatus comprising:

an image forming section for forming a toner image on a sheet; and the fixing device of claim 3 which heats, presses and fixes the toner image formed by the image forming section onto the sheet in the fixing nip portion.

* * * * *